US005785365A

United States Patent [19]

Lorey

[11] Patent Number: 5,785,365

[45] Date of Patent: Jul. 28, 1998

[54] ANTI-SNAGGING STRIKER

[75] Inventor: Mark Edward Lorey, Westland, Mich.

[73] Assignee: General Motors Corporation, Detroit, Mich.

[21] Appl. No.: 808,409

[22] Filed: Feb. 28, 1997

[51] Int. Cl.[6] ..... E05C 3/06

[52] U.S. Cl. ..... 292/216; 292/340

[58] Field of Search ..... 292/340, 216, 292/341.12, DIG. 41, DIG. 40, DIG. 73

[56] References Cited

U.S. PATENT DOCUMENTS 4,756,563 7/1988 Garwood et al. ..... 292/216
5,050,917 9/1991 Hamada et al. ..... 292/340
5,209,531 5/1993 Thau ..... 292/340
5,209,532 5/1993 Nakamura et al. ..... 292/216
5,316,354 5/1994 Arabia, Jr. et al. ..... 292/340

*Primary Examiner*—Steven N. Meyers
*Assistant Examiner*—Tuyet-Phuong Pham
*Attorney, Agent, or Firm*—Lawrence B. Plant

[57] ABSTRACT

An anti-snagging loop striker for use with a door latch for securing a door in a closed position on a vehicle. The striker includes a ramp adjacent the rivet head connecting the crossbar to the leading leg of the striker to prevent sheet metal from the door from catching on such head and impeding opening of the door from outside the vehicle following an accident.

4 Claims, 2 Drawing Sheets

ANTI-SNAGGING STRIKER

TECHNICAL FIELD

This invention relates generally to strikers for vehicle door latches, and more particularly to loop-type such strikers having anti-snagging crossbars.

BACKGROUND OF THE INVENTION

Vehicle door latches are well known in the art and serve to prevent unintended opening of the door. Latching mechanisms comprise various combinations of springs, gears, cams, levers, pivots and other such linkages, coacting to provide latching, unlatching, locking and unlocking functions, which mechanisms are well known in the art. One such latch is adapted to engage a loop-type striker which is a generally U-shaped member having two legs anchored to the doorframe (e.g., door jamb), and a crossbar extending between the legs outboard the doorframe. One such latch and loop-type striker design can be found in latches sold commercially by the General Motors Corporation, assignee of the present invention, and is disclosed in such U.S. Pat. Nos. as Garwood et al. 4,756,563 (issued Jul. 12, 1988), and Arabia, Jr. 5,316,354 (issued May 31, 1994), which patents are assigned to the assignee of the present invention. These patents and commercial latches are intended to be incorporated herein by reference. That design employs a loop-type striker wherein the crossbar between the striker's legs is generally wedge-shaped and nests within a substantially complementary bell-shaped mouth in the latch's housing when the door is closed to prevent up and down movement of the door relative to the vehicle body when the door is closed. More specifically and referring to Garwood et al., that design includes a vehicle door latch having a rotatable fork-bolt that cooperates with a loop-type striker. The striker includes a pair of legs which are riveted (i.e. headed over) to a mounting plate one end of the leg, and to a generally wedge-shaped crossbar at the other end of the leg. As the door is closed, the leading leg of the striker engages the trailing or outboard edge of the throat of the fork-bolt and rotates it to a latched position where the leading leg of the striker is trapped within the throat as shown in FIG. 1 of that patent. At the same time, the wedge-shaped crossbar of the loop-type striker nests within the generally bell-shaped mouth in the housing defined by the metal plate and wall.

Some countries (e.g. Japan) have government regulations which require that a vehicle's door be openable from outside the vehicle in the event of an accident. Occasionally, sheet metal from vehicle doors having loop-type strikers such as described above have caught, and become hung up on, either the leading or the trailing rivet heads that secure the crossbar to the leading and trailing legs of the striker respectively. The prior art has reduced the possibility of the door catching on the trailing rivet head by providing a shoulder (see 74 in the Figures) on the crossbar adjacent the trailing head. Catching on the leading head, however, can still occur.

SUMMARY OF THE INVENTION

The present invention contemplates an anti-snagging loop striker for use with a door latch for securing a door in a closed position on a vehicle. The striker includes a ramp adjacent the rivet head connecting the crossbar to the leading leg of the striker to prevent sheet metal from the door from catching on such head, and impeding opening of the door from outside the vehicle, following an accident. More specifically, the latch has a mouth for receiving a crossbar and a leading leg of the striker, and a rotatable fork-bolt having a throat that traps the leading leg therein when the fork-bolt is in a latched position. The loop striker has a base for mounting to a doorframe, a leading leg mounted to the base, a trailing leg carried by the base and spaced laterally from the leading leg, a discrete crossbar having an external face confronting the door, a first end on each of the legs adjacent the base, a distal end on each of the legs remote from the first end and riveted to the crossbar so as to provide spaced apart leading and trailing rivet heads protruding from the external face, and a ramp integral with the crossbar in the gap between the leading and trailing heads. The ramp has a lower end adjacent the trailing head and an elevated end adjacent the leading head to prevent the door from catching on the leading head and impeding opening of said door.

BRIEF DESCRIPTION OF THE DRAWINGS

The invention will be better understood when considered in the light of the following detailed description of certain specific embodiments thereof which are provide hereafter in conjunction with the several drawings in which.

DETAILED DESCRIPTION OF THE INVENTION

Figure 1:
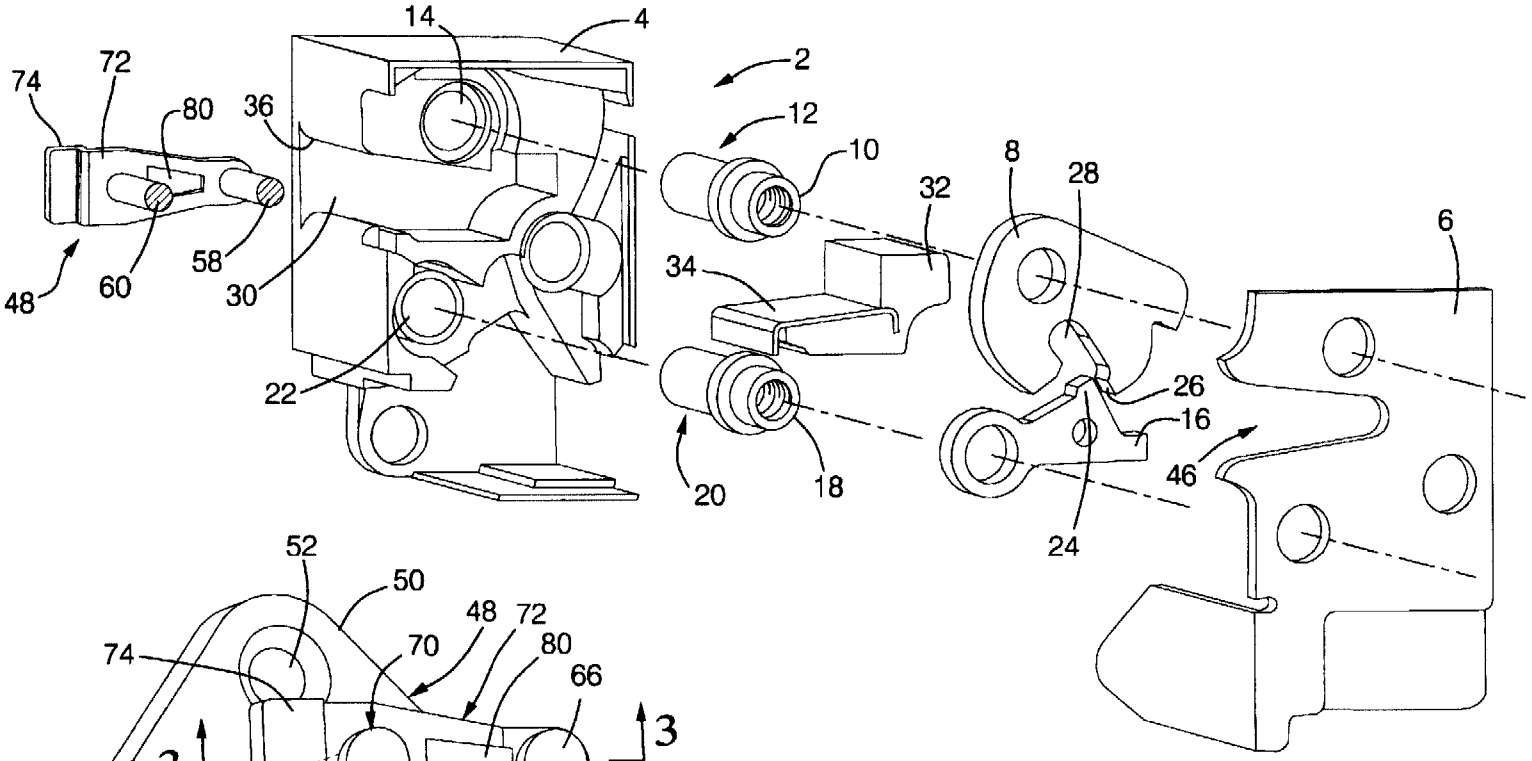
FIG. 1 is an exploded isometric view of portions of a door latch.

FIG. 1 is an exploded view of part of a door latch and striker combination showing only those components thereof which relate to an understanding of the present invention, but which does not include other springs, gears, cams, levers, pivots and other linkages which are common to such latches and are well known to those skilled in the art. More specifically, FIG. 1 shows a latch 2 having a plastic housing 4 secured to a metal frame member 6. The housing 4 houses a fork-bolt type latch-bolt 8 adapted to rotate about an outboard end 10 of a bushing 12 which seats in an aperture 14 in the housing 4. The housing 4 also houses a detent 16 which pivots about the outboard end 18 of bushing 20 fitted into opening 22 in housing 4. The detent 16 includes a shoulder 24 which is engageable with a shoulder 26 on the inboard leg of the latch-bolt 8 throat 28 to locate the latch-bolt in a fully latched position. Clockwise rotation of the detent 16 permits clockwise rotation of the latch-bolt 8 to permit unlatching of the latch 2. The plastic housing 4 includes an opening 30 which receives an insert 32 having a surface 34 thereon. When the insert 32 is positioned in the opening 30, the upper surface 34 on the insert 32 and undersurface 36 of the opening 30 define a generally bell-shaped mouth adapted to receive a complementary-shaped crossbar 38 which is riveted onto the distal ends of the trailing leg 40 and leading leg 42 of a striker 44, which will be described in more detail hereinafter. The frame 6 also includes a bell-shaped opening 46 which receives the leading leg 42 and trailing leg 40 of the striker 44 when the wedge-shaped crossbar 38 is positioned in the opening 30 in the housing 4, thus permitting the throat 28 of the latch-bolt 8 to engage the leading leg 42 (i.e., when latched) to secure the door firmly to the surrounding doorframe.

Figure 2:
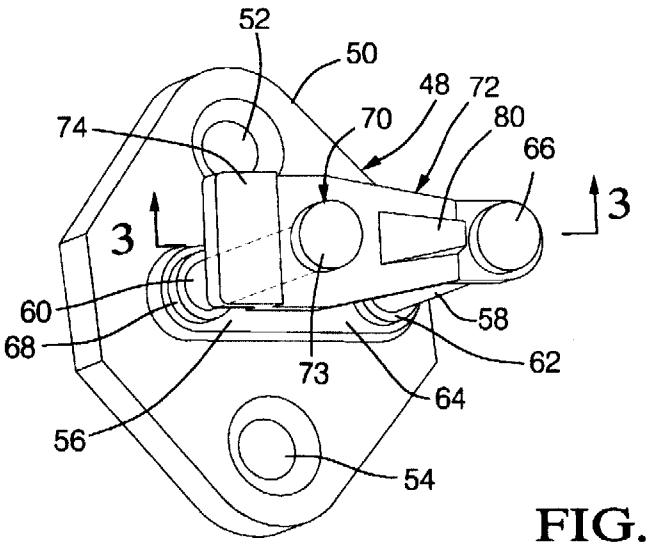
FIG. 2 is an isometric view of a loop-type striker in accordance with the present invention.
Figure 3:
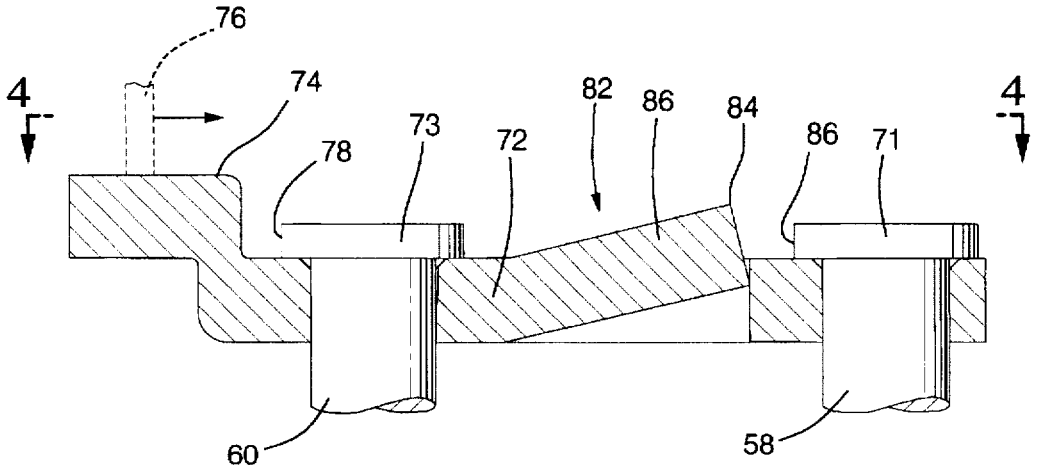
FIG. 3 is a sectioned view in the direction 3—3 of FIG. 2.
Figure 4:
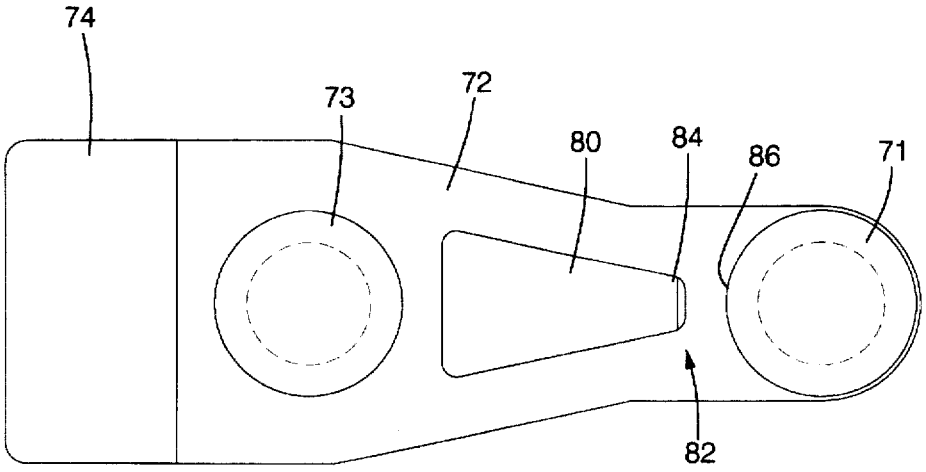
FIG. 4 is a plan view in the direction 4—4 of FIG. 3.

FIG. 2 depicts a loop-type striker 48 comprising a base 50 having holes 52 and 54 therethrough for mounting the base 50 to a vehicle doorframe (not shown). The base 50 includes a mesa 56 which in turn supports a first leg 58 (hereafter "leading" leg) and a second leg 60 (hereafter "trailing" leg). The leading leg 58 has a first end 62 mounted to the top 64 of the mesa 56 and a distal end 66 remote from the first end 62. Similarly, the trailing leg 60 has a first end 68 adjacent the top 64 of the mesa 56 and a distal end 70 remote from the first end 68. A crossbar 72 is riveted to the distal ends 66 and 70 of the leading and trailing legs 58 and 60 respectively heading over the distal ends 66 and 70 to provide a leading head 71 and trailing head 73 which hold the crossbar 72 to the legs 58 and 60. A shoulder 74 stands above the trailing head 73 to prevent sheet metal 76 (in phantom) from the door (moving from left-to-right in the Figure) from catching or hanging up on the outboard face 78 of the trailing head 73. In accordance with the present invention, a ramp 80 is formed (preferably stamped) in the gap 82 between the heads 71 and 73 such that the elevated end 84 of the ramp 80 is adjacent the leading head 71. As the sheet metal 76 moves from left-to-right, passed the trailing head 73, it engages the ramp 80 and is cammed up and over the leading head 71 so as to prevent it from catching on the inboard face 86 of the leading head. Alternatively rather than being stamped, a ramp in the form of a discrete insert could be secured to, or insert molded to (i.e., in the case of a plastic ramp), the crossbar 72.

While the invention has been disclosed primarily in terms of certain specific embodiments thereof it is not intended to be limited thereto but rather only to the extent set forth hereafter in the claims which follows.

I claim:

1. In a loop striker for use with a door latch for securing a door in a closed position on a vehicle, said latch having (1) a mouth for receiving a crossbar and a leading leg of said striker, and (2) a rotatable fork-bolt having a throat that traps said leading leg therein when the fork-bolt is in a latched position, said loop striker having (a) a base for mounting to a doorframe, (b) a leading leg mounted to said base, (c) a trailing leg carried by said base and spaced laterally from said leading leg, (d) a crossbar having an external face confronting said door, (e) a first end on each of said legs adjacent said base, (f) a distal end on each of said legs remote from said first end and riveted to said crossbar so as to provide leading and trailing heads protruding from said external face, said heads being spaced apart one from the other by a gap, the improvement comprising: a ramp integral with said crossbar in said gap, said ramp having a lower end adjacent said trailing head and an elevated end adjacent said leading head to prevent said door from catching on said leading head and impeding opening of said door.

2. A loop striker according to claim 1 wherein said ramp is formed from the material that comprises said crossbar.

3. A loop striker according to claim 2 wherein said ramp is a stamping.

4. A loop striker according to claim 3 wherein said crossbar is wedge-shaped having a narrow leading portion adjacent said leading head and a wider trailing portion adjacent said trailing leg.

* * * * *